US005720270A

United States Patent [19]

Meicke

[11] Patent Number: 5,720,270

[45] Date of Patent: Feb. 24, 1998

[54] MEANS FOR ADJUSTING THE SIGHT PIN OF A BOW

[75] Inventor: Raymond J. Meicke, Bixby, Okla.

[73] Assignee: Cobra Manufacturing Co., Inc., Bixby, Okla.

[21] Appl. No.: 564,938

[22] Filed: Nov. 30, 1995

[51] Int. Cl.[6] ..... F41B 5/00

[52] U.S. Cl. ..... 124/87; 33/265; 33/257

[58] Field of Search ..... 124/87, 88, 44.5, 124/86; 33/265, 241, 252, 253, 254, 256, 257, 258, 259, 260

[56] References Cited

U.S. PATENT DOCUMENTS

| | | | |
|---|---|---|---|
| 1,235,172 | 7/1917 | Warner et al. | 33/256 |
| 3,027,648 | 4/1962 | Crock | 33/46 |
| 3,058,221 | 10/1962 | McNeel | 33/265 |
| 3,270,418 | 9/1966 | Simeone et al. | 33/254 |
| 3,526,037 | 9/1970 | Crosby | 33/265 |
| 3,648,376 | 3/1972 | Millnamow | 33/265 |
| 3,693,262 | 9/1972 | Wood | 33/265 |
| 3,715,807 | 2/1973 | Heffer | 33/265 |
| 3,910,700 | 10/1975 | Sprandel | 33/265 X |
| 4,127,943 | 12/1978 | Trirtilli | 33/260 |
| 4,208,921 | 6/1980 | Power | 33/260 X |
| 4,473,959 | 10/1984 | Saltzman | 33/265 |
| 4,514,907 | 5/1985 | Saltzman | 33/265 |
| 4,742,636 | 5/1988 | Swan | 33/527 X |
| 4,953,302 | 9/1990 | Gould | 33/265 |
| 5,063,677 | 11/1991 | Millett | 33/254 X |
| 5,092,053 | 3/1992 | Roberts | 33/265 |
| 5,117,804 | 6/1992 | Jörlöv | 124/87 |
| 5,174,269 | 12/1992 | Sappington | 124/87 |
| 5,384,966 | 1/1995 | Gibbs | 33/265 |
| 5,408,778 | 4/1995 | Goodwin et al. | 33/259 X |
| 5,414,936 | 5/1995 | Sappington | 33/265 |
| 5,419,051 | 5/1995 | Barngrover | 33/265 |
| 5,533,494 | 7/1996 | Sacco | 124/44.5 |

*Primary Examiner*—Terry Lee Melius
*Assistant Examiner*—Thomas A. Beach
*Attorney, Agent, or Firm*—Scott R. Zingerman; Frank J. Catalano

[57] ABSTRACT

A sight pin is supported from a sight chassis. The sight chassis is slidably supported from a camshaft mounting bracket. The camshaft has a cam lobe which extends into an opening such as a slot or channel of selected shape in the sight chassis. Rotation of the camshaft rotates the cam lobe which is in the shaft slot or channel. This causes the sight chassis to move with respect to the bracket.

13 Claims, 8 Drawing Sheets

MEANS FOR ADJUSTING THE SIGHT PIN OF A BOW

BACKGROUND OF THE INVENTION

This invention relates to a bowsight for archery bows. It relates especially to means for adjusting the bowsight pin.

In archery, the term "cant" means the angle or tilt of the bow or bowsight. For example, the traditional shooting position of a bow is where the archer holds the bow generally perpendicular to the ground. Cant refers to tilt or angle of the bow or the sight when positioned in relation to the vertical axis. In target and tournament shooting where precision is critical, cant of a bow or bowsight could have a major impact on the accuracy and consistency of the archer.

Also when shooting at a selected target, the distance of the target influences the way in which the shooter will sight in on the target to compensate for the trajectory of the arrow as it is influenced by distance and gravitational force.

It is therefore seen that there is a need for improved sighting apparatus to aid the shooter in making his adjustment to improve his shooting accuracy.

SUMMARY OF THE INVENTION

This invention discloses apparatus for adjusting a sight pin in a shooting instrument to adjust for variations in shooting conditions, such as distance, manufacturing tolerances, and individual style. In this apparatus there are included a sight chassis for holding the sight pin, a support bracket for supporting the sight chassis, a mount bracket to connect the support bracket to the handle of the shooting instrument, and a cam lobe. The cam is rotationally supported within the body of the support bracket, and the lobe of the camshaft extends into an opening in the sight chassis. The sight chassis is supported at least at one point from the support bracket, all in a manner such that rotation of the camshaft and cam lobe causes movement of the sight chassis with respect to the support bracket.

In one embodiment the mounting of the sight chassis to the support bracket is by releasable holding means such as screws such that the sight chassis can be moved vertically from one fixed point to another fixed point. The sight chassis supports the sight needle which the shooter uses to direct the arrow. It is frequently desired to move the sight needle vertically to compensate for variations in the archer's style or equipment. In this embodiment, upon release of the holding means, the sight chassis is vertically slidably supported from the support bracket and adjacent thereto and can be moved by a cam lobe. The cam lobe extends into essentially a horizontal channel across the face of the sight chassis. Thus when the camshaft is rotated, the sight chassis moves up or down in accordance with the way of the rotation. The camshaft is rotated until the desired height of the sight needle is obtained. At that point the rotation of the camshaft is stopped and the sight chassis has been raised or lowered to the desired point so that the sight needle is in the proper position. The releasable holding means are then placed in the holding position.

In another embodiment, provisions are provided that permit the sight chassis to be tilted. In this embodiment there is still the sight chassis, the support bracket, and the bow mounting bracket. The support bracket is a vertical member having a top and a bottom. A bolt extends through a hole in the upper part of the camshaft support bracket through an upper hole in the sight chassis to give the sight chassis vertical support from the support bracket. A cone washer is mounted over the bolt in the hole of the support bracket to help form a pivot for the sight chassis.

The lower end of the sight chassis is provided with a threaded hole, and the lower end of the vertical member of the support bracket is provided with an oblong hole. A bolt extends through the oblong hole, through the lower hole in the sight chassis. Thus the sight chassis can rotate about the pivot point of the bolt in the upper hole of the support bracket to the extent of the length of the oblong hole. Means are provided to rotate the sight chassis about this upper pivot point. This includes a large diameter hole in said vertical member and a smaller diameter hole concentric therewith. A camshaft having a larger cylindrical portion and a smaller cylindrical portion and in which the smaller cylindrical portion extends through the smaller hole. The cam lobe extends into a cam receiving opening in the sight chassis. This receiving opening is generally a vertical oblong hole. Thus, when mounted, rotation of the camshaft causes rotation of the sight chassis about its pivot point. This in turn causes a tilting of the sight chassis which in turn causes a tilting of the sight needle.

It is therefore one object of this invention to provide a means for adjusting the vertical position of a sight needle.

It is another object of this invention to provide means for changing the tilt of the sight chassis and the sight needle.

These and other objects of the invention may be readily apparent from the description that follows in view of the drawings in which:

DETAILED DESCRIPTION OF THE PREFERRED EMBODIMENTS

Figure 3:
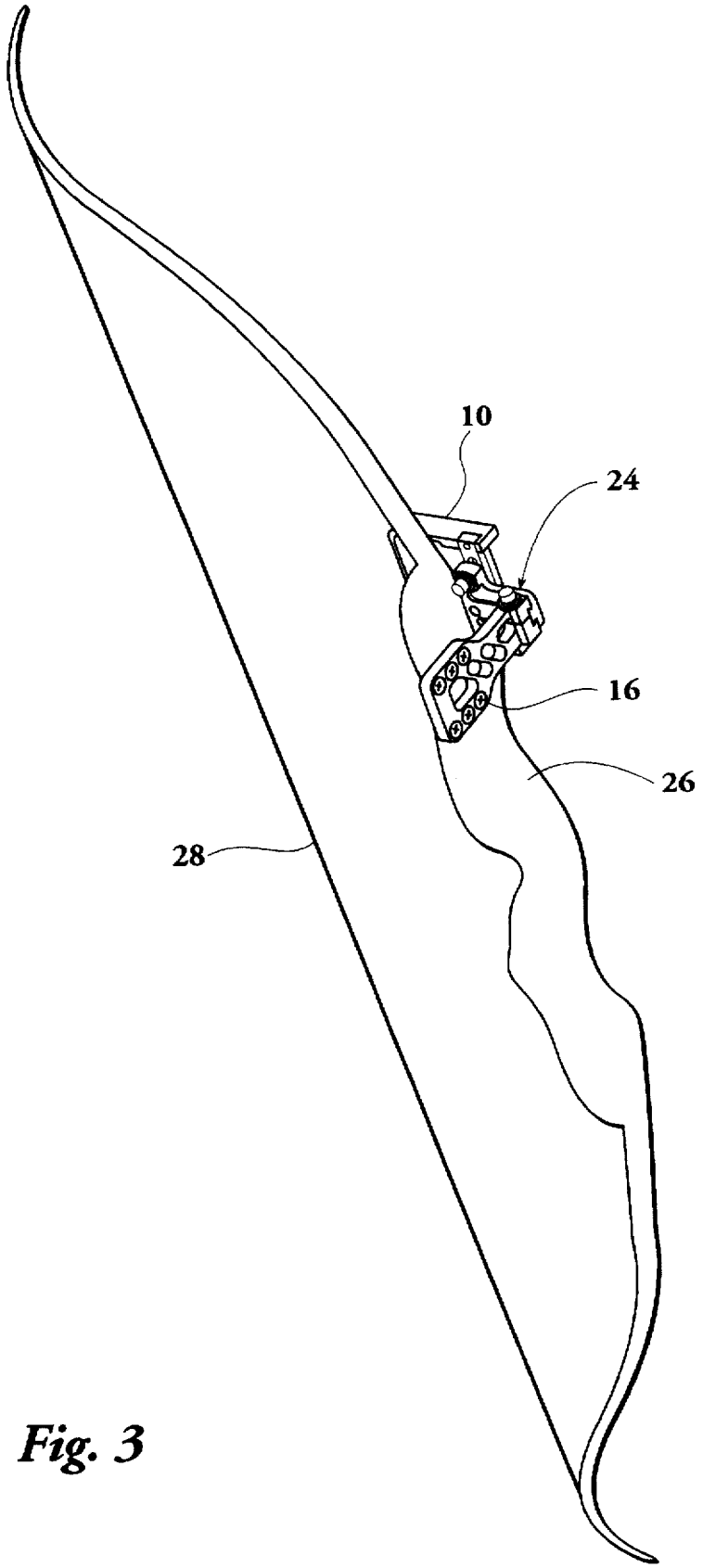
FIG. 3 illustrates how the apparatus of FIG. 1 is attached to an archery bow.

Attention will first be directed to the embodiment which provides means for vertically adjusting or moving the sight pin on a shooting instrument, such as a bow. Attention is now directed to FIG. 3 which shows a bowsight assembly 24 attached to archery bow handle 26. Also shown is bowstring 28.

Figure 1:
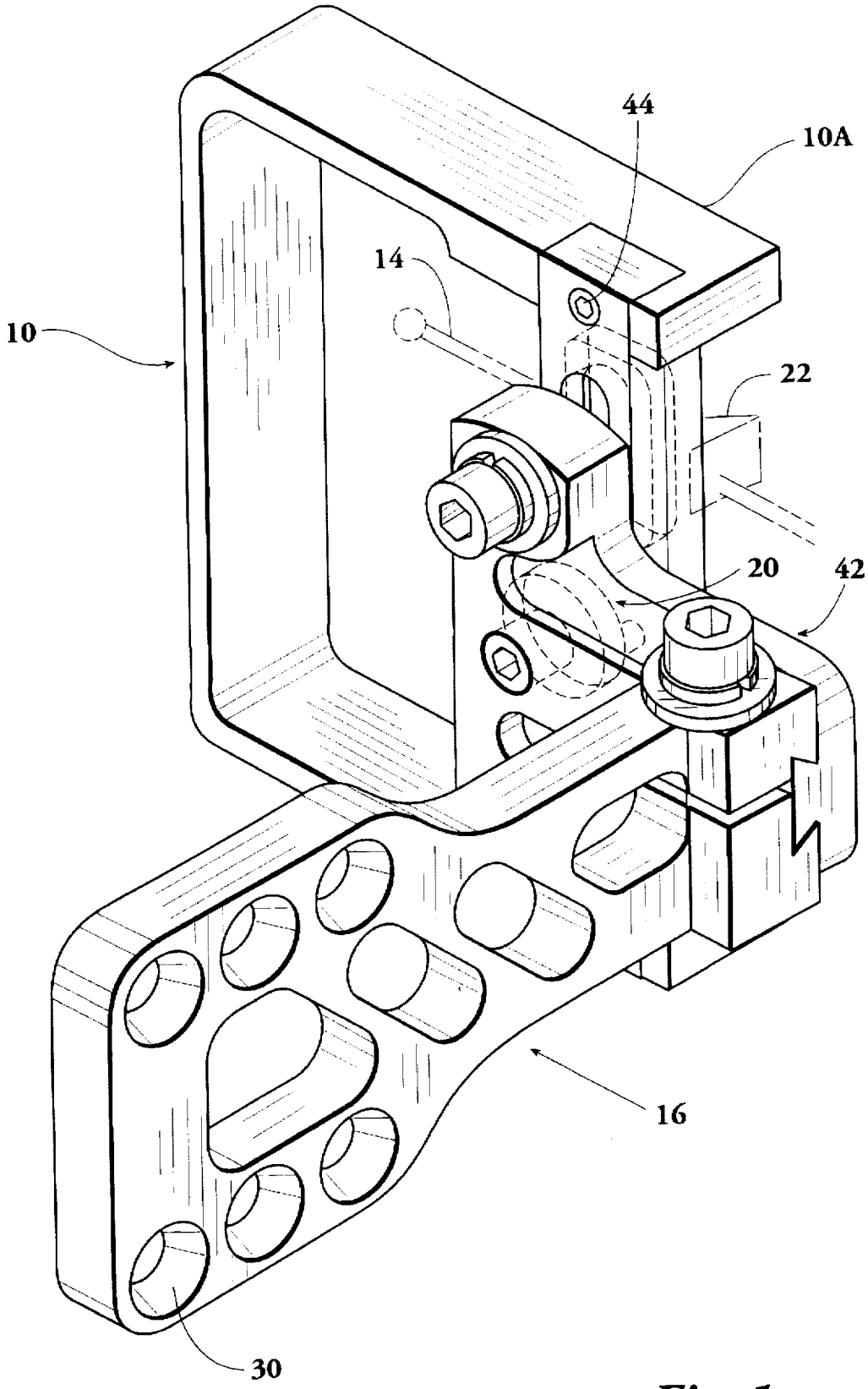
FIG. 1 is an isometric view of a bowsight assembly which permits varying the elevation of the sight pin.
Figure 2:
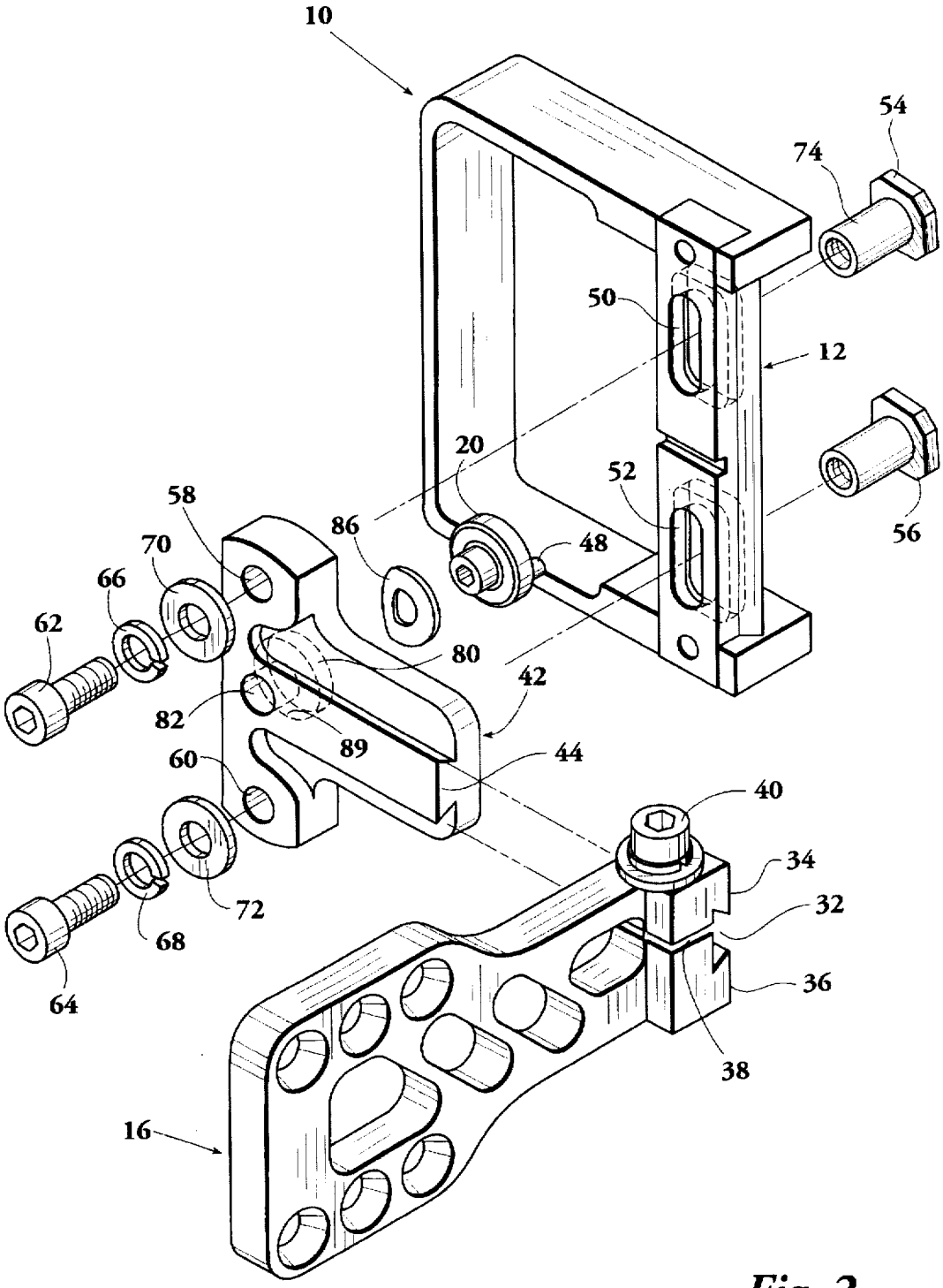
FIG. 2 is an exploded view of that apparatus of FIG. 1.

Attention is now directed primarily to FIGS. 1 and 2 which shows the bowsight assembly 24 in detail. In FIG. 1 there is a horizontal mounting bracket 16 which is used for attaching the camshaft support bracket 42 to the archery bow handle 26. This includes a plurality of holes 30 and a dovetail clamp 32 on one end thereof. This female dovetail clamp 32 has an upper section 34 and a lower section 36 which are separated by space 38. A screw 40 extends through a hole in upper portion 34 into threaded hole 36 in section 36 whereby tightening a screw 40 causes sections 34 and 36 to be squeezed together. A camshaft supporting bracket 42 has a windage dove slide (male) 44 which fits into a dovetail clamp (female) 32 as shown in FIG. 1. When the dovetail clamp 32 is positioned on the windage dovetail slide 44 at the proper distance to the desired position, screw 40 is tightened to maintain that position. This is a known clamping procedure. Thus, horizontal mounting bracket 16 is secured to camshaft supporting bracket 42 Holes 30 are used in attaching the bowsight assembly to the handle of a bow.

Pin guard 10 is essentially U-shaped and is supported by a vertical sight chassis 12 which is secured to pin guard 10 by screws 44 or other means. The top 10A of the pin guard has a recess into which the sight chassis 12 fits. The sight chassis 12 normally has a pin dovetail (not shown) which receives the pin block 22 which supports the sight pin 14 within the protection of pin guard 10. An average bow shooter will have four pin 14 block assemblies per sight. Only one is shown here for clarity in showing the operation of the overall system. The method of attaching a pin block 22 to a sight chassis 12 is known.

Figure 5:
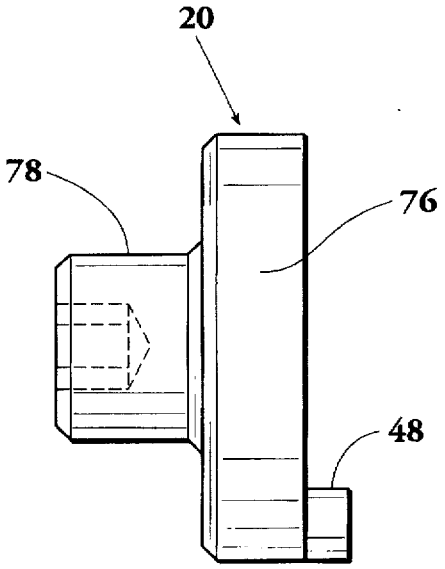
FIG. 5 is a side view of the apparatus of FIG. 4.
Figure 6:
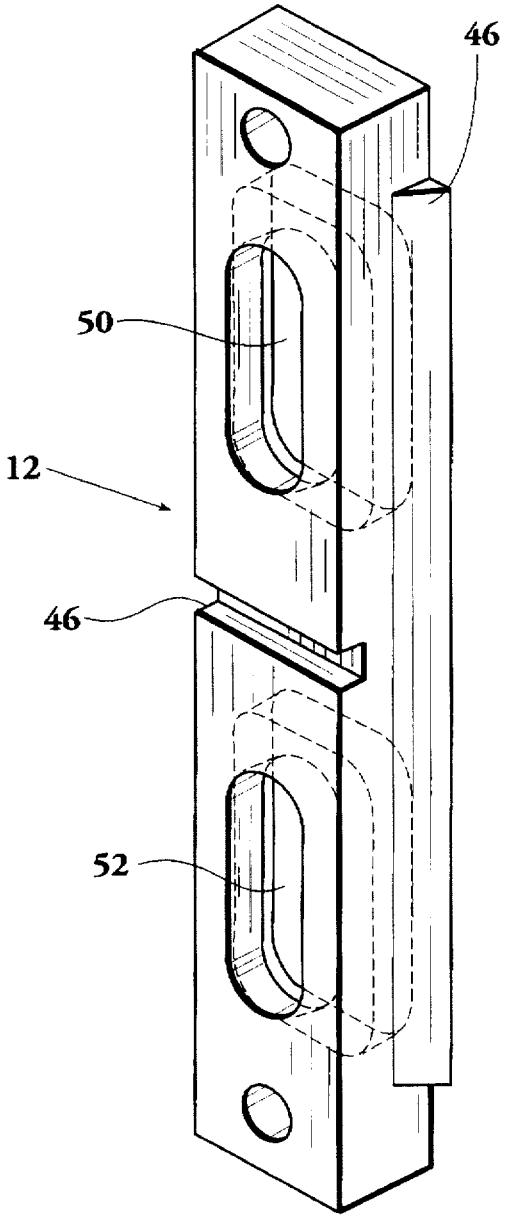
FIG. 6 is an isometric view of the sight chassis of the apparatus of FIG. 1.

Sight chassis 12 is a modified sight chassis. It includes a horizontal channel 46. This is especially clearly shown in FIG. 6. As will be seen this will, when assembled, contain or have inserted therein cam lobe 48 of camshaft 20 as illustrated especially in FIGS. 5 and 6. Sight chassis 12 has an upper oblong mounting hole 50 and a lower oblong mounting hole 52. As can be seen more clearly in FIG. 2, when it is desired to assemble the sight chassis 12 of the overall pin guard to the camshaft support bracket 42, shoulder nuts 54 and 56 extend through slots 50 and 52 through holes 58 and 60 of the camshaft supporting bracket 42. Socket head cap screws 62 and 64 each are provided with a lock washer 66 and 68 and flat washer 70 and 72, respectively. Screw 62 and 64 then extend through holes 58, 60 into shoulder nut 54 and 56, respectively. The cylindrical section 74 of shoulder nut 54 and 56 is only slightly smaller in diameter than the width of mounting slots 50 and 52 of the sight chassis 12. When assembled, this permits the pin guard to move up and down within the limits of the vertical length of the lock mounting slots 50 and 52. The sight chassis 12 is held in position by tightening the screws 62 and 64.

Figure 4:
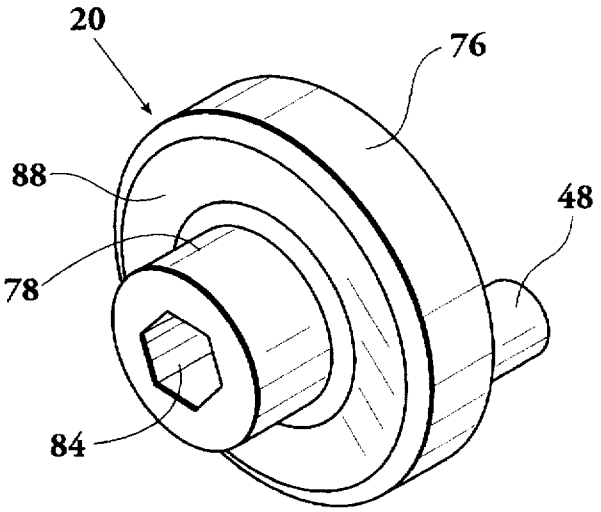
FIG. 4 is an isometric view of a camshaft as used in the apparatus of FIG. 1.

Attention is next directed toward means disclosed therein for raising and lowering the sight chassis 12 which supports the pin block 22 and sight pin 14. Thus lowering and raising this sight chassis 12 will raise or lower the pin 14. This is very important in accurate shooting of the bow and arrow. For example, it permits adjustments of the sight to fine tune it to an individual archer's needs. This adjustment mechanism includes camshaft 20 as shown in detail in FIGS. 4 and 5. This camshaft has a large cylindrical portion 76 and smaller cylindrical portion 78 which is concentric therewith. Portion 78 is provided with a hex pocket 84. The other side of a camshaft from hex pocket 84 is provided with a cam lobe 48. When assembled, the cam lobe 48 extends into an opening such as channel 46 of the sight chassis 12.

Camshaft support bracket 42 is provided with a first cylindrical hole 80 which goes only part way through the bracket 42 and opens on the side of the bracket toward the pin guard. A second cylindrical hole 82 which is concentric with hole 80 opens from the hole 80 into the outer side of bracket 42. Hole 80 is sized to readily receive cylindrical portion 76 of the camshaft 20, and hole 82 receives the cylindrical portion 78. An annular shoulder 89 is formed in bracket 42 between holes 80 and 82. A wave washer 86 is positioned around cylindrical portion 78 of the camshaft and fits snugly against internal annular shoulder 89. When assembled as shown in FIG. 1, the camshaft has lobe 48 which extends into the channel 46 of the sight chassis 12. Sight chassis 12 is thus held in position adjacent supporting bracket 42 by shoulder nut 54, 56 and socket head cap screws 62 and 64 and associated parts. The cam is thus held in position between the sight chassis 12 and the internal shoulder 89 of hole 80. The wave washer 86 provides friction between the camshaft 20 and the annular shoulder 89. As the lobe 48 is in channel 46 of the sight chassis 12, rotation of the cam will cause the sight chassis to raise or lower, depending on the rotation. The rotation of the camshaft 20 can be affected by use of an Allen or hex wrench in the hex pocket 64. When one wishes to adjust the position of sight pin 14, one loosens the screws 62 and 64, then rotates camshaft 20 until the desired position is obtained. Then screws 62 and 64 are tightened to maintain this position.

Some archers wish to adjust the canting to accommodate the archer's style and the manufacturing tolerances in the sighting device. I shall next describe the embodiment which permits this adjusting. This is shown in FIGS. 7, 8, 9, 10, 11, 12, and 13 which show this embodiment. Attention is first directed to FIG. 7 which is an exploded view of this embodiment. Shown thereon is a cam support bracket 101, a sight chassis 102, and a camshaft 100. The rotation of the camshaft 100 rotates sight chassis 102 about a cone washer 128 which is the pivot point and which fits into counter sink 124 of the top mounting hole in the cam support bracket 101. The pivot connection between the cam support bracket 101 and the sight chassis 102 will now be explained.

The top of the head of the cam support bracket 101 is provided with a hole therethrough which has a counter sink 124. A screw 126 having hex head 127 is insertable through a cone washer 128 which mates with the counter sink 124 and extends into threaded hole 122 of the sight chassis 102. The cone washer 128 fits snugly over screw 126. A lock washer 142 is also provided for screw 126.

Figure 8:
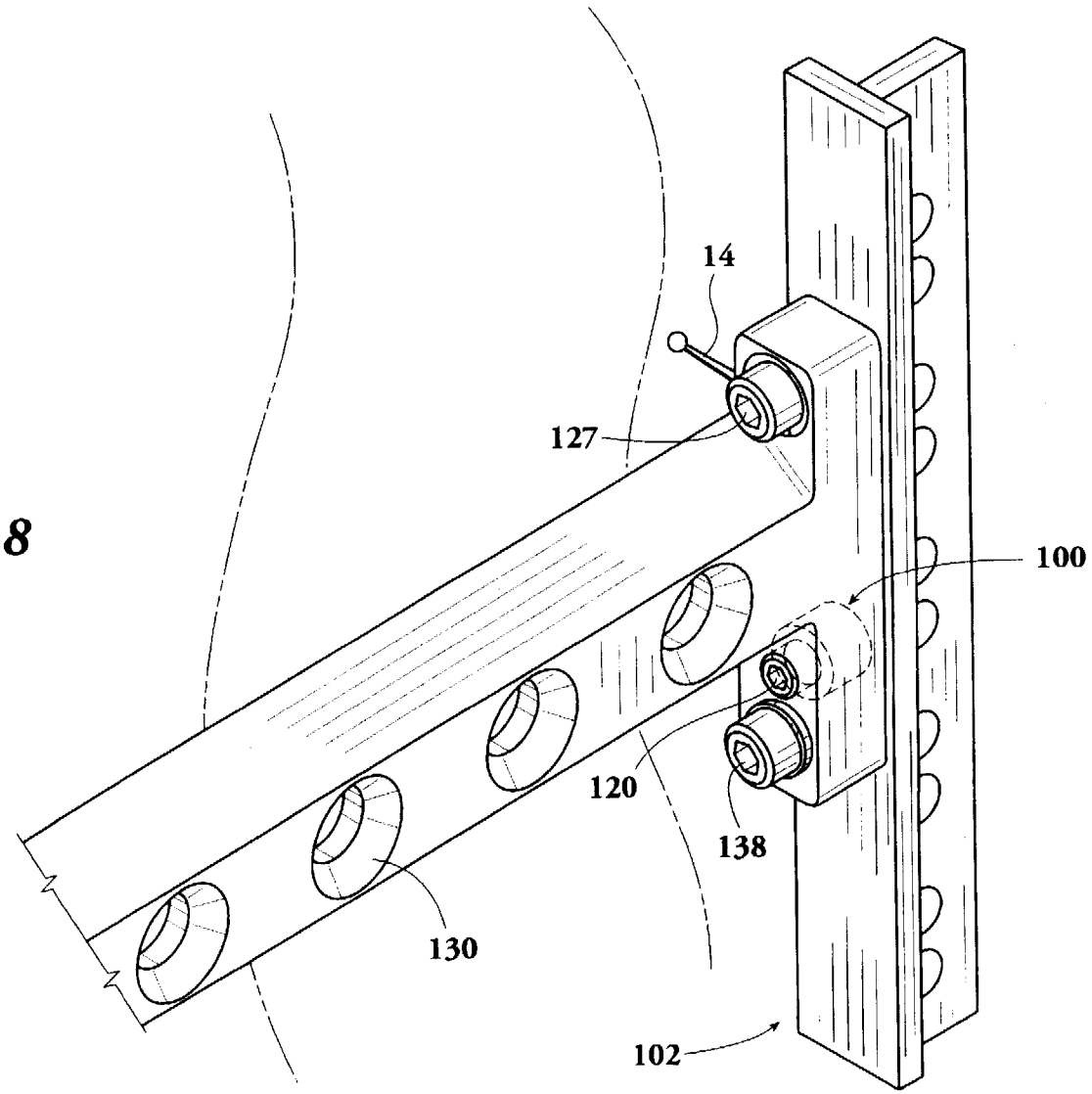
FIG. 8 is an isometric view of the apparatus of FIG. 7 in assembled form.
Figure 9:
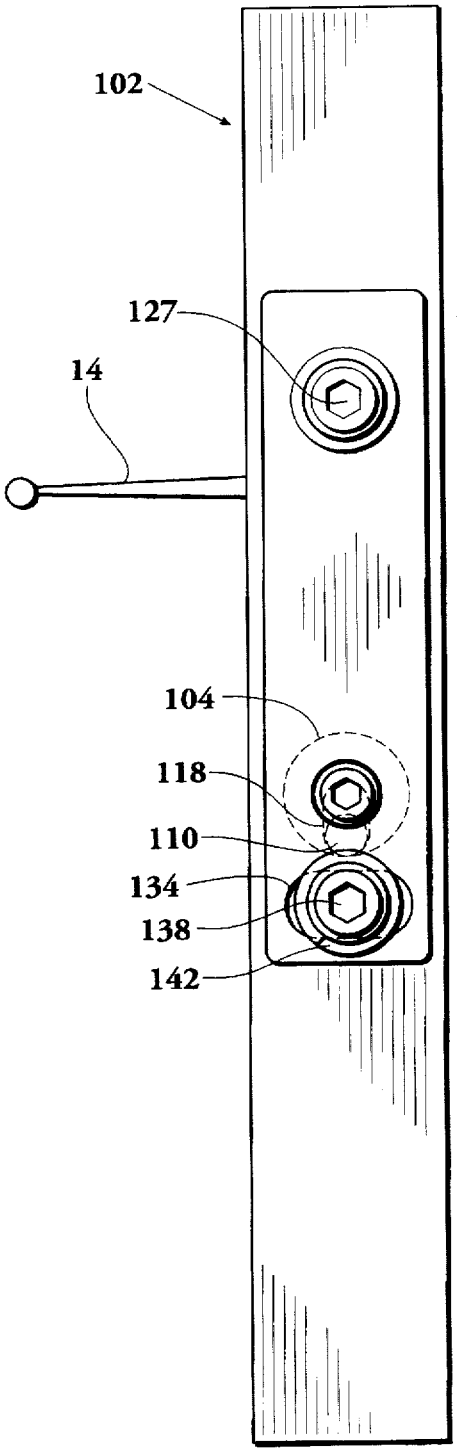
FIG. 9 is an end view of the apparatus of FIG. 8 showing the sight chassis in an at rest or vertical position.
Figure 10:
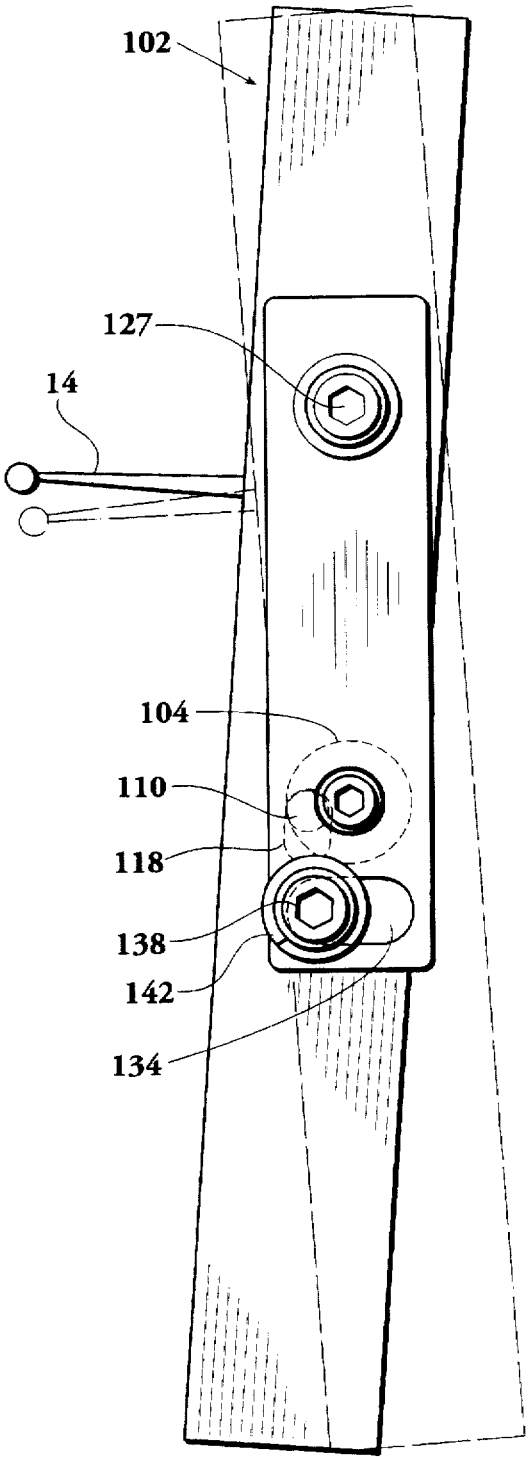
FIG. 10 is similar to FIG. 9 except that the sight chassis has been tilted with respect to its support bracket.

Sight chassis 102 is also connected to the cam support bracket 101 at a second location. This includes a threaded hole 132 in sight chassis 102. This connection is operable when connecting screws are loosened to permit rotation of sight chassis 102 about pivot defined by cone 124. This includes oblong hole 134 through the lower part of the head of the support bracket 101, a screw 136 with hex head 138 extends through a lock washer 142, flat washer 140, through hole 134, and can be screwed into hole 132 in the sight chassis 102. The hole 134 in the support bracket 101 is oblong shape or is sufficiently wide to permit rotation of sight chassis 102 when assembled as shown in FIG. 8 to provide for movement, specifically rotation about pivot point defined by the cone washer 128. Tightening of screws 126 and 136, when assembled as shown in FIG. 8, prevents any pivoting. When it is desired to pivot, these two screws are loosened.

Figure 7:
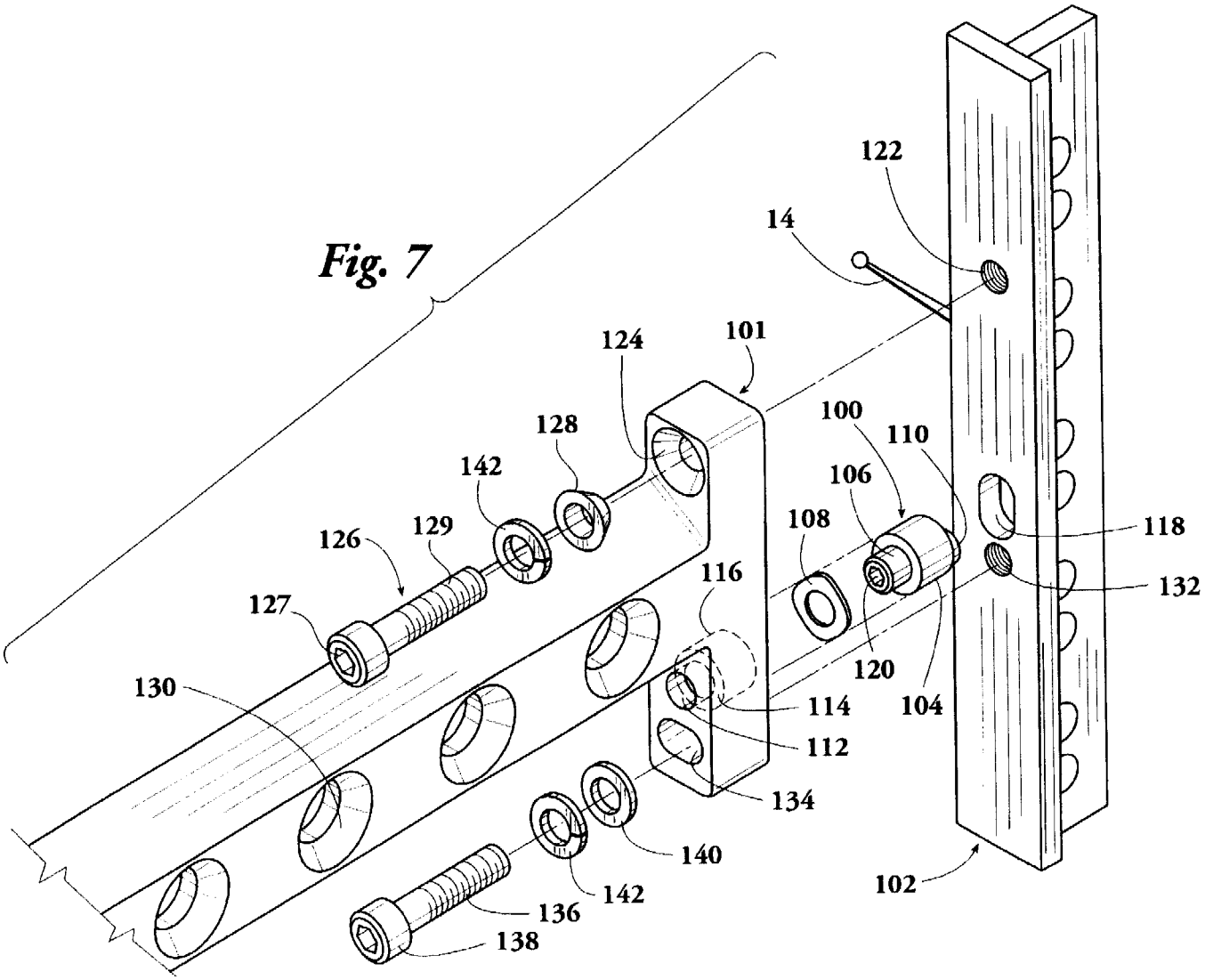
FIG. 7 is an exploded view of another embodiment of this invention which is useful in changing the tilt of a sight chassis.

The camshaft arrangement for rotating the sight chassis 102 about cam support bracket 101 will now be discussed. This includes a camshaft 100 having a lobe 110. The camshaft 100 has a large cylindrical section 104 and a smaller concentric cylindrical section or lobe 106 which is provided with a hex pocket. It also includes a wave washer 108. In the lower part of the cam support bracket 101 there is provided a first cylindrical hole 116 and a second cylindrical hole 112 concentric therewith. This forms an annular shoulder 114 against which wave washer 108 will contact when the device is assembled as shown in FIG. 8. The parts of exploded view of FIG. 7 are assembled into the device shown in FIG. 8. When it is desired to adjust the cant, i.e. adjust the angle of the sight chassis 102 with respect to the support bracket 101, one first loosens the screws 126 and 136. Then a hex wrench is used in hex pocket 120 to rotate the lobe 110. Lobe 110 is in oblong hole 118, and its rotation will cause the rotation of the sight chassis 102 about the pivot point as defined by the cone washer 128.

Figure 13:
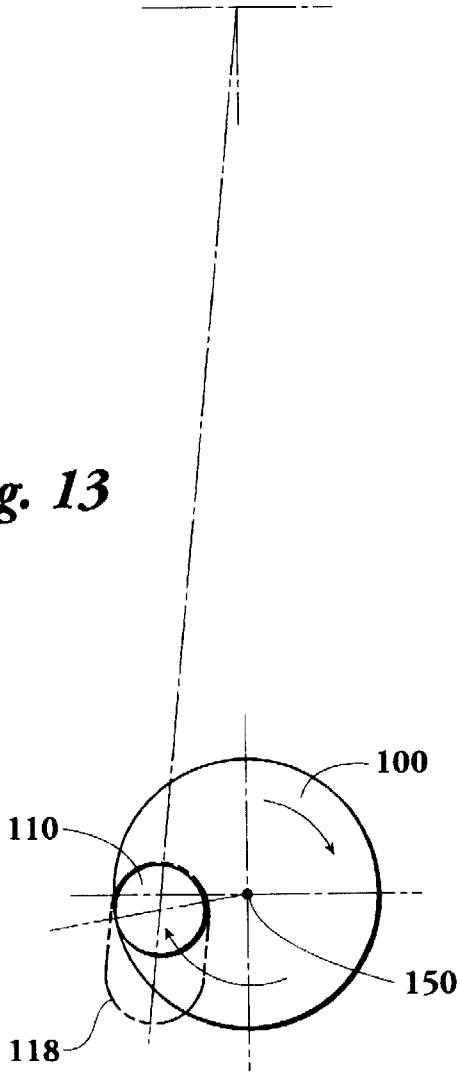
FIG. 13 is similar to FIG. 12 except that the cam lobe is then rotated clockwise to illustrate the position of the slot with respect to rotation of the cam lobe.
Figure 12:
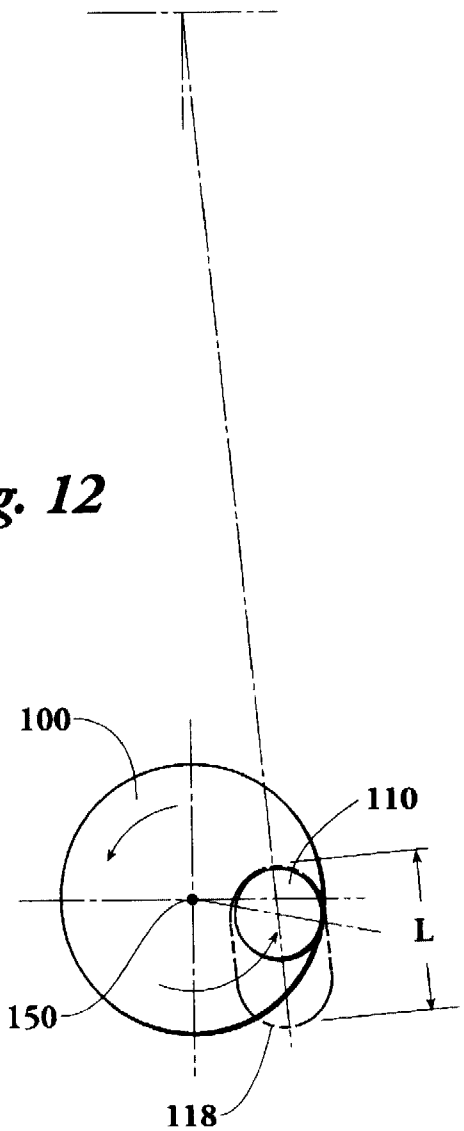
FIG. 12 is similar to FIG. 11 except that the camshaft has rotated the cam lobe counterclockwise.
Figure 11:
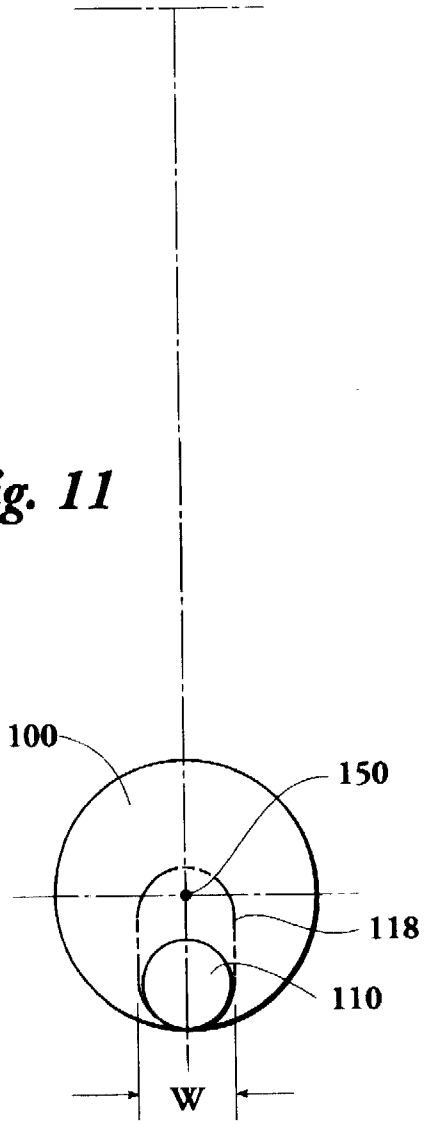
FIG. 11 illustrates the position of the cam lobe in the vertical oblong slot of the sight chassis of FIG. 8 when in the at rest position.

Attention is next directed to FIGS. 11, 12, and 13 which show the effect lobe 110 rotation with respect to slot 118 has on movement of sight chassis 102. Movement of the oblong slot 118 with respect to the lobe 110, i.e. change of position of lobe 110 in oblong slot 118, effects rotational movement of the sight chassis 102 about the pivot point. The position of center 150 of the camshaft 100 remains fixed with respect to the pivot 126. The width W of slot 118 should be equal to or slightly larger than the diameter of the lobe 110 to eliminate any backlash in the adjustment. The vertical length L of the slot as indicated in FIG. 12 will determine the amount of rotation of the sight chassis 102 about the pivot that will be permitted. It is considered desirable not to allow the camshaft to rotate 360°. Therefore, the slot is preferably made just long enough to allow plus or minus 80° of rotation from the home position as shown in FIG. 11. As the camshaft is rotated counterclockwise, the lobe 110 begins to move to the right and up simultaneously, resulting in a circular path. Since the width is equal to the lobe, the sight chassis which contains slot 118 immediately begins to move to the right. If the slot were round, it would bind since it would not be able to travel up. If the lobe could pass the 90° position of rotation, it would begin to travel back toward the left, that is, the horizontal dimension of its motion. This would permit rotation of the sight chassis about the pivot 128 but it is considered that this is undesirable since the counterclockwise rotation would result in both the left and right direction of travel. By controlling the length of the slot such that the cam is stopped after it has rotated about 80°, one can restrict the direction of travel to the right with counterclockwise rotation. If it is desired to move the sight chassis 102 to the left, then one would clockwise rotate it as shown in FIG. 13. Thus the camshaft must be reversed in direction to change the direction of the rotation of the sight chassis 102.

After the camshaft rotation has moved the sight chassis 102 about the pivot 128 to the desired position, screws 126 and 136 are tightened. This will hold the sight chassis in its proper canted position. It will also be noted that the sight needle 14 may be mounted to the sight chassis 102 similar to that as shown in the embodiment of FIGS. 1 and 2. Holes 130 are also provided in cam support bracket 101 so that it may be secured to the handle of a bow.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A sight assembly which comprises:

a support bracket;

a camshaft having at least one end, a cam extending from said end parallel to said camshaft;

means to support said camshaft from said support bracket;

a sight chassis having a cam lobe receiving opening for directly receiving said cam lobe and of a size to permit movement of said cam lobe within the opening;

mounting means to mount said sight chassis from said support bracket such that rotation of said camshaft causes movement of said sight chassis with respect to said support bracket.

2. A sight assembly for adjusting the vertical position of a sight which comprises:

a sight chassis for supporting said sight and having an essentially straight channel on one side thereof;

a camshaft having a lobe insertable into said channel;

means to support said cam lobe in said channel such that rotation of said camshaft moves the sight chassis in a direction perpendicular to the axis of rotation of said camshaft.

3. A sight assembly as defined in claim 2 including a pin block attached to said sight chassis and a pin guard supported from said sight chassis.

4. A sight assembly as defined in claim 2 including a camshaft support bracket and in which said camshaft has a large cylindrical section and a smaller concentric cylindrical section, and forming an annular shoulder, said camshaft support bracket includes a first hole essentially about the same diameter as the larger cylindrical portion of said camshaft and not extending all the way through said supporting bracket and a second hole of smaller diameter than and concentric with said first hole to form a retaining annular shoulder therein which is of a size to receive said annular shoulder of said camshaft and a wave washer between said shoulders.

5. A sight assembly as defined in claim 4 in which said sight chassis has two spaced apart oblong slots therethrough, said camshaft support bracket having two spaced apart holes;

a shoulder nut extending through each of the said oblong slots in said sight chassis and extending through said holes in said camshaft supporting bracket;

a cap screw for screwing into said shoulder nut such that said sight chassis can move along a line between the two said shoulder nuts within the confines of the oblong slots.

6. A sight assembly as defined in claim 5 including a horizontal mounting bracket attached to said camshaft supporting bracket and of a character for attaching to a handle of a bow.

7. A sight assembly which comprises:

a camshaft having a cam lobe on one end and means for rotating said camshaft on the other end;

a support bracket having a.) a passage therethrough for receiving said camshaft, b.) an upper hole therethrough, and c.) an oblong hole therethrough and spaced from said upper hole therethrough;

a sight chassis having a.) an upper hole therein for alignment with said upper hole in said support bracket, b.) a cam lobe receiving slot aligned to receive the cam lobe, and c.) a lower hole aligned with said oblong hole of said support bracket;

a first bolt extending through said upper hole in said support bracket and extending into said first hole in said sight chassis to provide pivotal support;

a second bolt for insertion through said oblong passage and through said second hole in said sight chassis;

whereby rotation of said camshaft will cause said sight chassis to pivot about said first bolt.

8. An assembly as defined in claim 7 in which said first hole in said support bracket has a flared opening and also including a cone washer mounted over said first bolt to be inserted into said flared portion to form a pivot point.

9. An assembly as defined in claim 7 in which the camshaft has a large diameter cylindrical section and a smaller diameter section in which said support bracket camshaft receiving passage includes a first cylindrical opening and a second concentric cylindrical opening forming an annular shoulder and including a wave washer positioned against said annular shoulder and in which said smaller cylindrical diameter portion of said camshaft extends through said wave washer and through said smaller diameter opening of said support bracket.

10. A sight assembly as defined in claim 7 in which said cam lobe is cylindrical, said cam lobe receiving slot has a width W which is about equal to the diameter of said cam lobe.

11. A sight assembly as defined in claim 10 in which said cam receiving slot has a length which limits the rotation of said camshaft to not over about 90°.

12. A sight assembly for adjusting the vertical position of a sight which comprises:

a sight chassis for supporting said sight and having a channel on one side thereof;

a camshaft having a lobe insertable into said channel;

means to support said cam lobe in said channel such that rotation of said camshaft moves the sight chassis in a direction perpendicular to the axis of rotation of said camshaft;

a camshaft support bracket in which said camshaft has a large cylindrical section and a smaller concentric cylindrical section, and forming an annular shoulder, said camshaft support bracket includes a first hole essentially about the same diameter as the larger cylindrical portion of said camshaft and not extending all the way through said supporting bracket and a second hole of smaller diameter than and concentric with said first hole to form a retaining annular shoulder therein which is of a size to receive said annular shoulder of said camshaft and a wave washer between said shoulders.

13. A sight assembly which comprises:

a support bracket;

a camshaft having a cylindrical portion having at least one end and a cam lobe extending from said end; said camshaft and said cam lobe each having a longitudinal axis such that the longitudinal axis of said cam lobe extends generally parallel to the longitudinal axis of said camshaft;

means to support said camshaft from said support bracket;

sight chassis having a cam lobe receiving opening for directly receiving said cam lobe and of a size to permit movement of said cam lobe within the opening;

mounting means to mount said sight chassis from said support bracket such that rotation of said camshaft causes movement of said sight chassis with respect to said support bracket.

* * * * *